US008270622B2

(12) United States Patent
Tiodor et al.

(10) Patent No.: US 8,270,622 B2
(45) Date of Patent: Sep. 18, 2012

(54) APPARATUS AND METHOD FOR MONITORING OWN VOICE DURING SINGING OR SPEAKING EVENT

(76) Inventors: Robert F. Tiodor, West Warwick, RI (US); Sandra L. Tiodor, West Warwick, RI (US)

( * ) Notice: Subject to any disclaimer, the term of this patent is extended or adjusted under 35 U.S.C. 154(b) by 876 days.

(21) Appl. No.: 12/284,057

(22) Filed: Sep. 18, 2008

(65) Prior Publication Data

US 2009/0074196 A1 Mar. 19, 2009

Related U.S. Application Data

(60) Provisional application No. 60/994,250, filed on Sep. 18, 2007.

(51) Int. Cl.
*H04R 29/00* (2006.01)
*H04R 25/00* (2006.01)

(52) U.S. Cl. ..... 381/58; 381/375

(58) Field of Classification Search ..... 381/56–59, 381/375

See application file for complete search history.

(56) References Cited

U.S. PATENT DOCUMENTS 4,893,344 A 1/1990 Trägardh et al.
6,078,825 A 6/2000 Hahn et al.
6,952,481 B2 10/2005 Larsen et al.
7,262,358 B2 * 8/2007 Lubbers ..... 84/625

OTHER PUBLICATIONS

LM386 Low Voltage Audio Power Amplifier (Manufacturer's Data Sheet).
NTE823 Integrated Circuit Low Voltage Audio Amplifier (Manufacturer's Data Sheet).

* cited by examiner

*Primary Examiner* — Ramon Barrera
(74) *Attorney, Agent, or Firm* — James Ray & Assoc

(57) ABSTRACT

A headset includes a housing having an inner side thereof engageable at least with a human ear and a curved member for attaching the housing behind the ear. An audible sound emitting speaker is mounted within the housing and a microphone capable of receiving sound wave and for converting the sound wave into an electrical signal is connected to one end of a boom. The other end of the boom is attached to the housing. An amplifier is disposed within the housing and is operatively connected to the speaker and the microphone for amplifying the electrical signal. A manually operable variable volume control resistive switch is operatively disposed between the amplifier and the microphone for controlling amplification of the electrical signal. A battery is contained within the housing and supplies a predetermined voltage to the amplifier and microphone. A manually operable switch controls voltage supply from the battery.

15 Claims, 3 Drawing Sheets

APPARATUS AND METHOD FOR MONITORING OWN VOICE DURING SINGING OR SPEAKING EVENT

CROSS-REFERENCE TO RELATED APPLICATIONS

This application is related to and claims priority from Provisional Patent Application Ser. No. 60/994,250 filed on Sep. 18, 2007.

FIELD OF THE INVENTION

The present invention relates, in general, to speak/listen headsets and, more particularly, this invention relates to a speak/listen headset and method that enables a person to monitor his/her own voice during singing or speaking event.

BACKGROUND OF THE INVENTION

As is generally well known, many singers and musicians are concerned of not being able to hear their own voice when using a microphone. This concern can cause the performer to sing off key or lose track of his or her place in the song. The same concern is shared by a single speaker or a group of speakers. Accordingly, sound floor monitors, being essentially unidirectional sound emitting speaker or speakers directed toward a performer, are provided to alleviate this concern. However, use of floor monitors has a number of disadvantages. Each floor monitor requires its own amplifier and connection to the sound mixing control panel which increases the cost of the providing such sound monitoring. Feedback problems are also commonly prominent, especially during use of omnidirectional microphones in performances requiring a plurality of performers, for example such as church choirs. These problems can reduce the quality of the performance as well as reduce the enjoyment of the audience.

Therefore, there is a need for an apparatus capable of alleviating feedback problems and the inability of the performer to hear his or her own voice during singing or speaking event.

SUMMARY OF THE INVENTION

In a first aspect, the invention provides a headset for monitoring person's own voice during speaking and singing event characterized by presence of at least one microphone and absence of floor based sound monitors. The headset includes a housing. The housing has an inner side thereof engageable with at least one of a human ear and a predetermined portion of skin adjacent such human ear. A speaker is mounted within the housing. A fastening means is provided for attaching the housing to such at least one of such human ear and such predetermined portion of skin adjacent such human ear and for positioning the speaker in operative communication with an external auditory ear canal. A boom has a first end thereof operatively affixed to the housing. A microphone is operatively affixed to an opposed second end of the boom for receiving audible sound wave and for converting the sound wave into an electrical signal. The microphone is positioned in close proximity to a person's mouth. An amplifier is disposed within the housing. The amplifier is operatively connected to the speaker and the microphone for amplifying the electrical signal generated thereby. A volume control means is operatively disposed between the amplifier and the microphone for controlling amplification of the electrical signal generated thereby. A battery is also contained within the housing and supplies a predetermined voltage to each of the amplifier and the microphone. A voltage supply control means is provided and is operatively disposed in a path of the predetermined voltage supply from the battery for selectively controlling supply of the predetermined voltage therefrom.

In a second aspect, the invention provides a method for at least one of substantially eliminating feedback noise and enabling at least one person to monitor own voice during at least one of a singing and speaking event in an environment characterized by each of a presence of an event microphone and absence of floor based sound monitors. The method includes the step of positioning a unidirectional microphone in close proximity to a mouth of the at least one person. Then, positioning a speaker in operative communication with an external auditory ear canal of the at least one person. Next, generating, by way of the microphone, an electrical signal characterizing a first audible sound wave emitted from a mouth of the at least one person. Amplifying, by way of an amplifier operatively coupled between the microphone and the speaker and coupled to a power supply, the electrical signal. Finally, emitting, by the speaker in response to the amplified electrical signal, a second audible sound wave being substantially equal to the first audible sound wave.

OBJECTS OF THE INVENTION

It is, therefore, one of the primary objects of the present invention to provide a headset that enables the user to monitor his or her own voice during singing or speaking event.

Another object of the present invention is to provide a voice monitoring headset that is suitable for a performer having a low pitch voice.

Yet another object of the present invention is to provide a voice monitoring headset that enables the user to control the volume of his or her own heard voice.

A further object of the present invention is to provide a voice monitoring headset that is economical to manufacture.

Yet a further object of the present invention is to provide a voice monitoring headset that is simple to use.

An additional object of the present invention is to provide a voice monitoring headset that eliminates the need for floor based sound monitors.

Another object of the present invention is to provide a voice monitoring headset that alleviates feedback problems commonly associated with floor based sound monitors.

A further object of the present invention is to provide a method of employing a headset for at least one of substantially eliminating feedback noise and enabling a person to monitor own voice during at least one of a singing and speaking event.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 4:
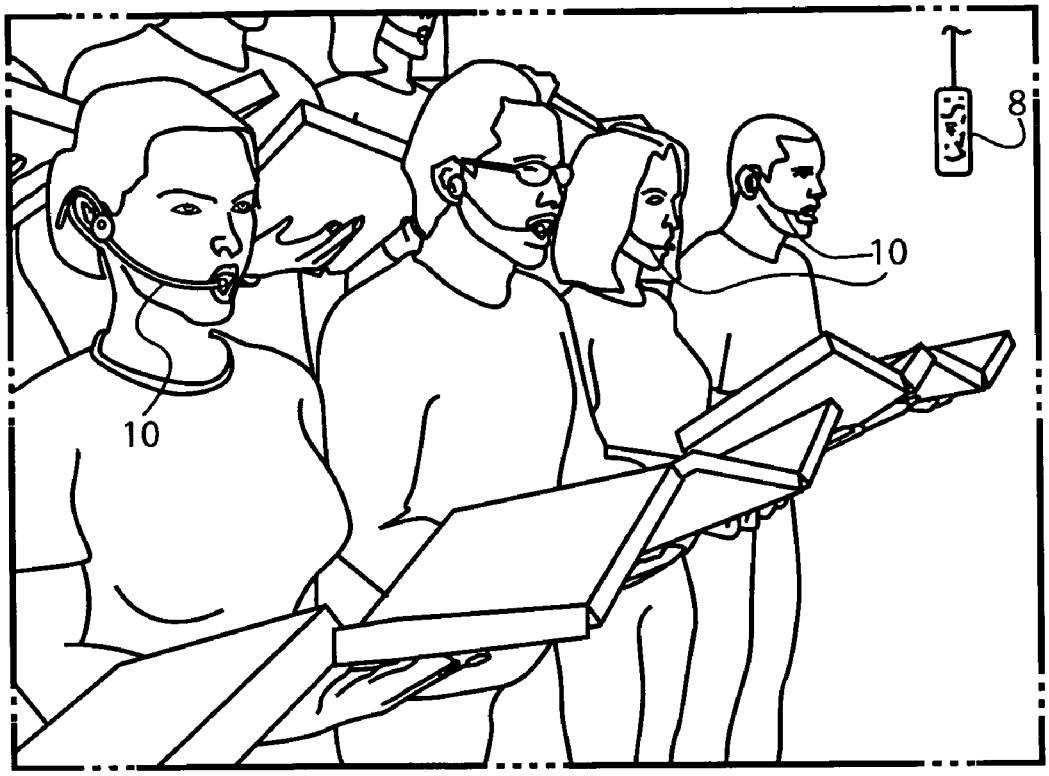
FIG. 4 illustrates an environmental view of the headset of FIG. 1.

Prior to proceeding to the more detailed description of the present invention, it should be noted that, for the sake of clarity and understanding, identical components which have identical functions have been identified with identical reference numerals throughout the several views illustrated in the drawing figures.

It is to be understood that the definition of a singing event includes but is not limited to concert, musical, choir and the like performances and that definition of a speaking event includes but is not limited to speech, theatrical play, news program, keynote address, stand-up comedy and the like.

The best mode for carrying out the invention is presented in terms of its presently preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one particular configuration shall be shown and described for purposes of clarity and disclosure and not by way of limitation of scope.

The present invention provides a headset enabling a person to monitor own voice during a singing or speaking event in an environment characterized by presence of at least one microphone and absence of floor based sound monitors. The present invention is illustrated and described as attachable behind a person's ear, however, it will be apparent to those skilled in the relevant art that the present invention may be applied to other types of headsets, including use of a conventional headband or a pair of ear capsules.

Figure 1:
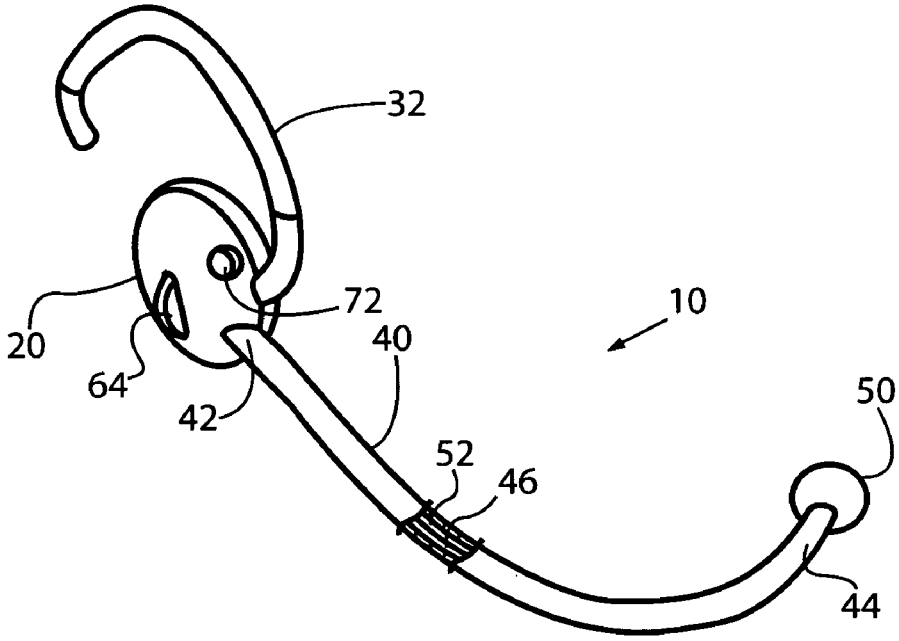
FIG. 1 illustrates an isometric view of a headset for monitoring own voice of the present invention.
Figure 2:
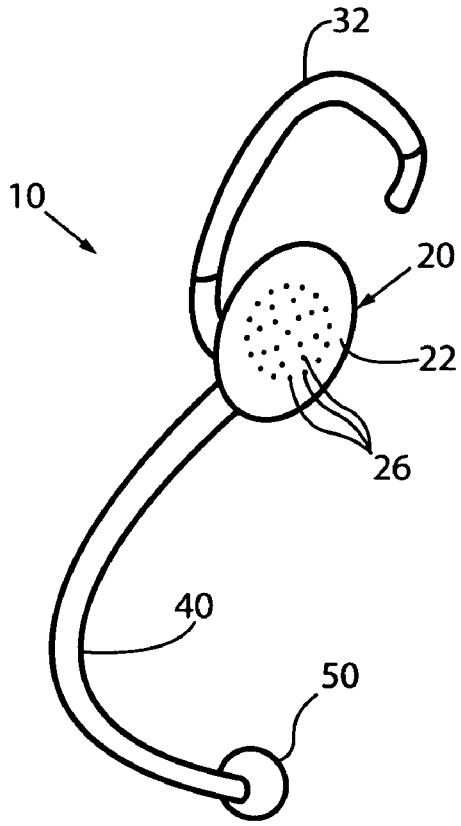
FIG. 2 illustrates an interior elevation view of the headset of FIG. 1.
Figure 3:
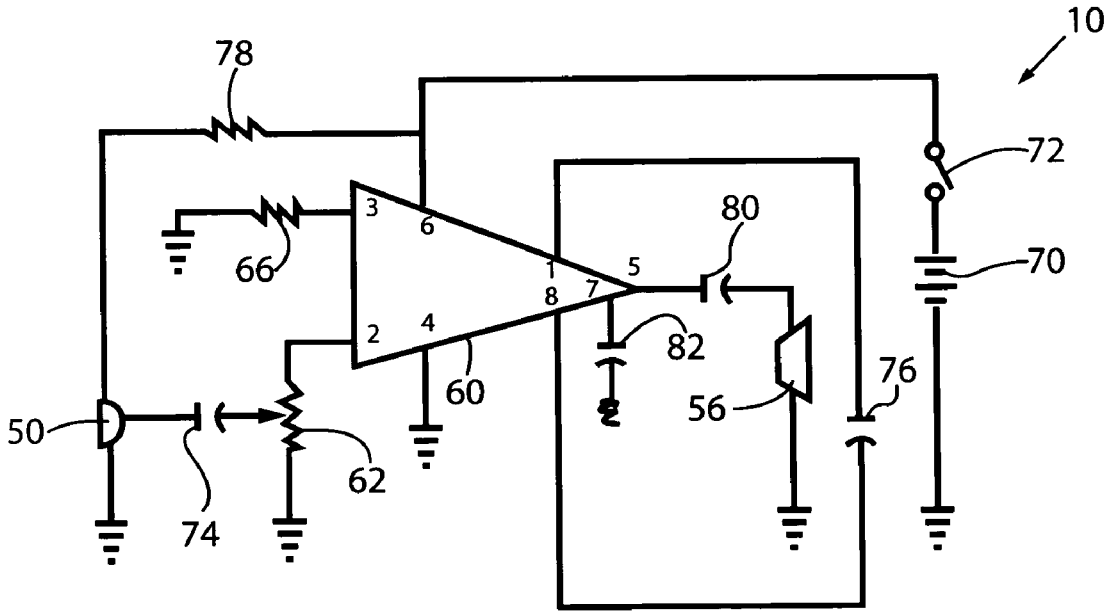
FIG. 3 illustrates a schematic diagram of the headset of FIG. 1.

Reference is now made, to FIGS. 1-3, wherein there is shown a headset, generally designated as 10, for monitoring person's own voice during speaking or singing event. The headset 10 includes a housing 20 having an inner side 22 thereof engageable with at least one of a human ear and a predetermined portion of skin adjacent such human ear. There is a fastening means for attaching the housing 20 to such at least one of such human ear and such predetermined portion of skin adjacent such human ear. In accordance with presently preferred embodiment of the invention, such fastening means includes a curved post auricle mount 32 arranged to be positioned behind such human ear and having one end thereof secured operatively secured to the housing 20. There is also a boom 40 having a first end 42 thereof operatively affixed to the housing 20. A microphone means 50 is operatively affixed to an opposed second end 44 of the boom 40 for receiving sound wave and for converting the sound wave into an electrical signal. The boom 40 may be of any conventional type and may have a predetermined curve or may have a flexible construction so as to position the microphone 50 in close proximity to person's mouth. By way of an example only, such boom 40 may be of the type disclosed in U.S. Pat. No. 4,893,344 issued to Tragardh et al. By way of other examples, the boom 40 and the mount 32 may be of the types as disclosed in U.S. Pat. No. 6,952,481 issued to Larsen et al. and U.S. Pat. No. 6,078,825 issued to Hahn et al. Teachings of U.S. Pat. No. 4,893,344, U.S. Pat. No. 6,952,481 and U.S. Pat. No. 6,078,825 are incorporated into this document by reference thereto.

An audible sound generating and emitting device, such as a speaker 56, is mounted within the housing 20. Conventional apertures 26 may be formed through the inner side 22 for facilitating emission of the generated audible sound. The curved post auricle mount 32 is adapted to position the speaker 56 in operative communication with an external auditory ear canal.

There is also an amplifier 60 which is disposed within the housing 20 for amplifying the electrical signal generated by the microphone 50. In accordance with presently preferred embodiment of the invention, the amplifier 60 is an integrated circuit low voltage audio power amplifier, for example such as model NTE823 manufactured by NTE Electronics, Inc. of Bloomfield, N.J. The microphone 50 is coupled to the negative input of the amplifier 60 while the speaker 56 is coupled to the output of the amplifier 60.

The headset 10 also employs a volume control means which is operatively disposed between the amplifier 60 and the microphone 50 for controlling amplification of the electrical signal generated thereby and, essentially control the volume of the audible sound generated and emitted by the speaker 56. Such volume control means includes a variable electrical resistor 62 coupled to the amplifier 60 and regulating current supply thereto. The variable electrical resistor 62 is manually adjustable, for example by a rotating wheel 64, from an outer side 24 of the housing 20. A resistor 66 is provided and is coupled to both a ground and the amplifier 60 for balancing the input from the variable electrical resistor 62.

Other two essential elements of the present invention are a battery 70 contained within the housing 20 for supplying a predetermined voltage to each of the microphone 50 and the amplifier 60 and a voltage supply control means, such as a conventional ON/OFF switch 72 operatively disposed in a path of the predetermined voltage supply from the battery 70 for selectively controlling supply of the predetermined voltage to the microphone 50 and the amplifier 60.

In further accordance with a presently preferred embodiment of the invention, the connection between microphone 50 and amplifier 60 is achieved by way of at least one wire 52 to reduce manufacturing costs of the headset 10. Accordingly, the boom 40 has a hollow internal passage 46 to receive such at least one wire 52. The connection between the output of the amplifier 60 and the speaker 56 is also by way of a wire or a metallic trace. Alternatively, wireless connections are also contemplated by the present invention providing that in applications employing a plurality of headsets 10, each headset 10 is operating at unique frequency and/or by assuring that multiple headsets 10 will not interfere with each other.

The present invention enables monitoring of low pitch voice, such as baritone, by providing a capacitor 74 operatively coupled in a path of the electrical signal between the microphone 50 and the amplifier 60 and having a capacitance between about eight (8) microfarads and about twelve (12) microfarads.

A capacitor 76 is operatively coupled to the amplifier 60 for increasing amplifier gain. Such capacitor 76 has a capacitance of between about four (4) microfarads and about six (6) microfarads.

There is also a resistor 78 operatively disposed between the positive terminal of the battery 70 and the microphone 50 for dropping the voltage from the battery 70 in order to assure proper operation of the microphone 50. The value of the resistor is determined based on a selected type of the microphone 50.

Furthermore, there is a capacitor 80 operatively disposed between the amplifier 60 and the speaker 56 for blocking passage of a direct current (DC) signal thereto thus preventing popping and shorting of the output of the amplifier 60. Such capacitor 80 preferably has capacitance between about eight (8) microfarads and about twelve (12) microfarads.

A capacitor 82 connected to the bypass input of the amplifier 60 is also employed.

In use, as best illustrated in FIG. 4, the user of the headset 10 sings or speaks in a conventional manner in a direction of a microphone 8 which may be of unidirectional or omni directional type. It will be appreciated that the user essentially emits and audible sound wave from the mouth. The microphone 50, which is preferably of a unidirectional type, within the headset 10 receives the audible sound wave and converts it into electrical signal which is then amplified at the amplifier 60 and is outputted therefrom to the speaker 56. The speaker 56 converts the output into an emitted audible sound wave which is substantially equal to the audible sound wave emitted from the mouth of the user. Thus, the user can easily monitor his or her own voice during a signing or speaking event.

Figure 5:
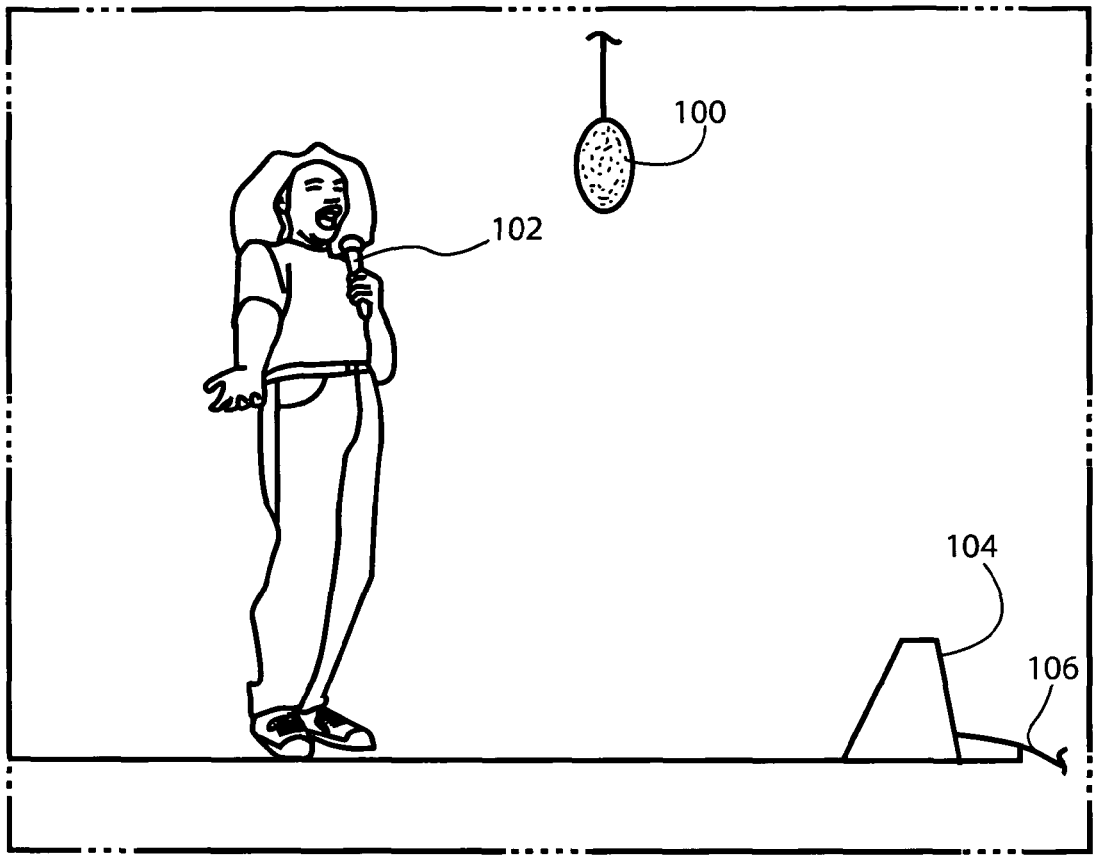
FIG. 5 (Prior Art)
FIG. 5 illustrates a prior art arrangement for monitoring voice of a person during singing or speaking event.

The headset 10 of the present invention is most advantageous in a multi-user event, for example such as a choir performance and, more particularly choir performance in closed confines, for example such as a church. As best shown in FIG. 5, conventional monitoring of the voice being picked-up by omnidirectional microphone 100 or unidirectional microphone 102 is performed by floor monitors 104 which are essentially speakers emitting a sound toward the person. In closed confines, such as a church, the use of floor sound monitors is generally prohibited as the sound therefrom bounces off the walls and ceiling thus providing undesirable feedback. Therefore, in a choir performance, the singer cannot monitor his or her own voice. Furthermore, use of floor monitors in such environment requires laying wire cables from the floor monitors to the sound mixing control board. The wire cables are usually exposed to the public and such exposure is often objected to by the clergy. Furthermore, exposed wire cables may pose a tripping hazard. The present invention eliminates disadvantages associated with inability of each singer in a choir to monitor his or her own voice and solves the feedback problem associated with the use of floor monitors 104. The unidirectional microphone 50 of the present invention, positioned in close proximity to the mouth, only picks-up the sound wave from its user, thus substantially eliminating sound pick-up from another person located in close proximity. Thus, each singer in a choir environment can independently monitor his or her voice.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. In combination with at least one of speaking and singing event characterized by presence of at least one event microphone and absence of floor based sound monitors, a headset for monitoring person's own voice, said headset comprising:

(a) a housing having an inner side thereof engageable with at least one of a human ear and a predetermined portion of skin adjacent such human ear;

(b) a speaker mounted within said housing;

(c) a fastening means for attaching said housing to such at least one of such human ear and such predetermined portion of skin adjacent such human ear and for positioning said speaker in operative communication with an external auditory ear canal;

(d) a boom having a first end thereof operatively affixed to said housing;

(e) a microphone operatively affixed to an opposed second end of said boom for receiving audible sound wave and for converting said sound wave into an electrical signal, whereby said microphone is positioned in close proximity to person's mouth;

(f) an amplifier disposed within said housing and operatively connected to said speaker and said microphone for amplifying said electrical signal generated thereby;

(g) a volume control means operatively disposed between said amplifier and said microphone for controlling amplification of said electrical signal generated thereby;

(h) a battery contained within said housing and supplying a predetermined voltage to each of said amplifier and said microphone; and (i) a voltage supply control means operatively disposed in a path of said predetermined voltage supply from said battery for selectively controlling supply of said predetermined voltage therefrom.

2. The headset, according to claim 1, wherein said fastening means includes a curved post auricle mount arranged to be positioned behind such human ear.

3. The headset, according to claim 1, wherein said boom includes each of a hollow internal passage and a predetermined curved shape.

4. The headset, according to claim 1, wherein said volume control means includes a variable electrical resistor manually operable and adjustable from an outer side of said housing.

5. The headset, according to claim 4, wherein said volume control means includes a capacitor having a capacitance of between about eight microfarads and about twelve microfarads.

6. The headset, according to claim 1, wherein said amplifier is a low voltage integrated circuit audio power amplifier.

7. The headset, according to claim 6, wherein said headset includes a capacitor operatively disposed between said amplifier and said speaker.

8. The headset, according to claim 7, wherein said capacitor has a capacitance of between about eight microfarads and about twelve microfarads.

9. The headset, according to claim 6, wherein said headset includes a capacitor operatively coupled to said amplifier for increasing amplifier gain.

10. The headset, according to claim 9, wherein said capacitor has a capacitance of between about four microfarads and about six microfarads.

11. The headset, according to claim 1, wherein said microphone is a unidirectional microphone.

12. The headset of claim 1, further including a resistor operatively disposed between a positive terminal of said battery and said microphone.

13. The headset of claim 1, wherein said voltage supply control means includes a switch operable from an outer side of said housing.

14. In combination with at least one of speaking and singing event characterized by presence of at least one event microphone and absence of floor based sound monitors, a headset for monitoring person's own voice, said headset consisting of:

(a) a housing having an inner side thereof engageable with at least one of a human ear and a predetermined portion of skin adjacent such human ear;

(b) a speaker mounted within said housing;

(c) a fastening means for attaching said housing to such at least one of such human ear and such predetermined portion of skin adjacent such human ear and for positioning said speaker in operative communication with an external auditory ear canal;

(d) a boom having a first end thereof operatively affixed to said housing;

(e) a unidirectional microphone operatively affixed to an opposed second end of said boom for receiving sound wave and for converting said sound wave into an electrical signal, whereby said microphone is positioned in close proximity to person's mouth;

(f) a low voltage integrated circuit audio power amplifier disposed within said housing;

(g) a variable electrical resistor disposed in a path of said electrical signal and coupled to said amplifier, said variable electrical resistor manually operable and adjustable from an outer side of said housing for controlling amplification of said electrical signal;

(h) a first resistor coupled to each of said amplifier and ground for balancing operation of said variable electrical resistor;

(i) a first capacitor disposed between said microphone and said variable electrical resistor and sized for enabling amplification of said electrical signal representative of a low pitch voice;

(j) a second capacitor operatively connected to each of an output of said amplifier and said speaker and sized for blocking passage of a direct current signal thereto;

(k) a third capacitor coupled to said amplifier and sized for setting a predetermined gain;

(l) a forth capacitor coupled to each of said amplifier and said ground;

(m) a battery contained within said housing and supplying a predetermined voltage to each of said amplifier and said microphone;

(n) a voltage supply control means operatively disposed in a path of said predetermined voltage supply from said battery for selectively controlling supply of said predetermined voltage therefrom; and (o) a second resistor operatively disposed in said path of said predetermined voltage supply from said battery for reducing said voltage supply to said microphone.

15. The headset of claim 14, wherein said voltage supply control means includes a switch operable from an outer side of said housing.

* * * * *